US010357106B1

(12) United States Patent
Lee et al.

(10) Patent No.: US 10,357,106 B1
(45) Date of Patent: Jul. 23, 2019

(54) RACK FOR VARIOUS ITEMS

(71) Applicants: Lawrence Lee, Piney Flats, TN (US); Daniel Pope, Johnson City, TN (US)

(72) Inventors: Lawrence Lee, Piney Flats, TN (US); Daniel Pope, Johnson City, TN (US)

( * ) Notice: Subject to any disclaimer, the term of this patent is extended or adjusted under 35 U.S.C. 154(b) by 0 days.

(21) Appl. No.: 15/795,116

(22) Filed: Oct. 26, 2017

(51) Int. Cl.

| | |
|---|---|
| ***A47B 96/14*** | (2006.01) |
| ***A47B 61/04*** | (2006.01) |
| ***B25H 3/04*** | (2006.01) |
| ***A47B 61/00*** | (2006.01) |
| ***A47B 81/00*** | (2006.01) |

(52) U.S. Cl.
CPC ..... *A47B 96/1475* (2013.01); *A47B 61/003* (2013.01); *A47B 61/04* (2013.01); *A47B 81/005* (2013.01); *B25H 3/04* (2013.01)

(58) Field of Classification Search
CPC . A47B 81/005; A47B 96/1475; A47B 61/003; A47B 61/04; B25H 3/04
USPC ..... 211/66, 85.3, 34, 35
See application file for complete search history.

(56) References Cited

U.S. PATENT DOCUMENTS 2,664,933 A * 1/1954 Gielow ..... A63B 55/20 206/315.5
2,680,513 A * 6/1954 Murphy ..... B65D 85/34 206/557
2,969,881 A * 1/1961 Lilly ..... B60R 7/10 211/105.3
3,349,922 A * 10/1967 Morrison ..... A47G 25/746 211/113
4,049,126 A * 9/1977 Halverson ..... A63B 71/0045 211/104
4,082,209 A * 4/1978 Sanders ..... A63B 47/002 211/15
4,629,065 A * 12/1986 Braaten ..... A63B 69/0002 206/315.1
4,854,456 A * 8/1989 Lee ..... A47B 81/007 211/14
5,294,005 A * 3/1994 Hedges ..... A47F 5/083 211/85.7
5,462,328 A * 10/1995 Chandler ..... A63B 47/00 294/143
5,690,235 A * 11/1997 Matzen ..... A63B 71/0045 211/60.1
6,267,461 B1 * 7/2001 Dunagan ..... A63B 47/002 312/49
6,439,424 B1 * 8/2002 Threadgill, Jr. ..... A63B 47/002 221/185
6,481,595 B1 * 11/2002 Chilton ..... A63B 47/002 221/185
D479,423 S * 9/2003 Mahoney ..... D6/552
6,663,119 B2 * 12/2003 White ..... A63B 47/002 280/47.26
6,719,306 B2 * 4/2004 White ..... A63B 47/002 280/47.26

(Continued)

*Primary Examiner* — Patrick D Hawn
(74) *Attorney, Agent, or Firm* — Michael J. Folise; Ellen M. Bierman; Lowe Graham Jones PLLC

(57) ABSTRACT

A method and apparatus are disclosed for providing a coat rack, a shoe rack and a tool rack all modified from a staple commodity of construction commerce such as polyvinyl-chloride piping. Methods for modifying this construction material for a specific use as one of the various types of racks is disclosed along with the tools and techniques necessary for such modifications.

1 Claim, 9 Drawing Sheets

(56) References Cited

U.S. PATENT DOCUMENTS

| | | | | |
|---|---|---|---|---|
| 7,740,143 | B2 * | 6/2010 | White | A47B 43/006 211/85.7 |
| 7,789,248 | B1 * | 9/2010 | Salerno | A47G 25/08 211/85.7 |
| 7,997,594 | B1 * | 8/2011 | Mortazavi | B62B 1/008 206/315.9 |
| 8,371,457 | B2 * | 2/2013 | Entz | A47B 43/00 211/85.7 |
| 8,613,411 | B1 * | 12/2013 | Mohns | F16L 3/1226 174/135 |
| 9,402,494 | B1 * | 8/2016 | O'Brien | A47F 7/12 |
| 9,834,960 | B2 * | 12/2017 | Chesterton | E05B 73/0094 |
| 2006/0144806 | A1 * | 7/2006 | Joannou, Jr. | A47B 81/00 211/85.7 |
| 2008/0277362 | A1 * | 11/2008 | White | A47B 43/006 211/85.7 |
| 2012/0198680 | A1 * | 8/2012 | Durben | A47G 25/08 29/428 |
| 2018/0169502 | A1 * | 6/2018 | Reed, Jr. | A63B 57/20 |

* cited by examiner

RACK FOR VARIOUS ITEMS

TECHNICAL FIELD

The application relates to storage racks for various items. More specifically, the invention relates to wall mounted storage racks for shoes, articles of clothing, tools with handles, fishing rods and the like.

BACKGROUND OF THE INVENTION

Use of racks for clothing, tools, shoes, etc. have existed for many years. Typically, such racks are built to be purpose specific and are not generally amendable to cross uses. While such racks, bookshelves, and the like function well for their intended purposes, their use specific design necessarily incorporates additional expenses related to the cost of construction, the materials used, shipping costs, etc., all of which cannot be combined across purposes for economy of scale.

A significant effort has been made over the years to provide kits and the like for assembly by home owners into purpose specific racks such as tool racks, shoe racks, clothing racks, etc. Traditionally, such kits are available at home improvement stores throughout North America. While the provision of such kits on a do-it-yourself basis significantly reduced manufacturing costs, and sometimes shipping costs, economies of scale could not be achieved because the various parts required for each specific use were not interchangeable across uses. Furthermore, the homeowner or do-it-yourselfer required use specific tools for assembling the various different types of racks, complicating the assembly procedure for the homeowner. Finally, the various use specific types of racks often involved vastly different materials such as wood, metal and plastic which increased the cost to warehouse and stock such materials at the various home improvement stores even if a homeowner or do-it-yourselfer was going to assemble a use specific rack from raw materials.

Thus, a need exists for a wall mounted rack made from a single raw material or stock item for supporting various different types of items.

A further need exists for a rack of the type described which can be prepared with a simple set of conventional tools.

A yet further need exists for a rack of the type described above which can be manufactured or modified from an inexpensive and relatively available stock item.

BRIEF SUMMARY OF THE INVENTION

It is therefore an object of the present invention to provide for a rack for various items which can provide a wall mounted rack made from a single raw material or stock item for supporting various different types of items.

It is a further object of the present invention to provide for a rack of the type described which can be prepared with a simple set of conventional tools which achieves the above object.

It is yet another object of the present invention to provide for a rack of the type described above which can be manufactured or modified from an inexpensive and relatively available stock item which achieves the above objects.

The invention achieves the above objects, and other objects and advantages which will become apparent from the description which follows, by providing an elongated rack for attachment to a support surface such as a wall for supporting items of clothing, tools, fishing rods, shoes, and the like. The rack preferably includes an elongated, substantially hollow cylindrical body defining a longitudinal axis and at least one transverse aperture for receipt of a plurality of items. Means such as holes are provided in the cylindrical body for mounting the rack on a support surface, such as a wall, including screws, nails, etc. In a preferred embodiment of the invention, the cylindrical body comprises conventional polyvinylchloride (hereinafter "PVC") piping having a nominal outside diameter of either 3.5 inches or 1.9 inches, so called 3 inch diameter PVC pipe and 1.5 inch diameter PVC pipe respectively.

The rack in its variety of preferred embodiments can comprise a shoe rack, a coat or clothing rack, or a fishing rod/tool rack depending on the diameter of piping selected and the specific configuration of the transverse aperture.

In the shoe rack embodiment, the transverse aperture can be a single elongated slot having a height selected and a cylindrical body diameter selected to accept toe portions of footwear such that the footwear is supported from the rack in a cantilevered fashion. In the context of a coat or clothing rack, a plurality of spaced apart transverse apertures are provided including an integral curved portion in the form of a tongue so as to form a hook for supporting the items of clothing therefrom. In the context of a fishing rod or tool rack, preferably a plurality of apertures less than the diameter of the PVC piping are provided having axes transverse to the longitudinal axis of the pipe. The center of the transverse apertures are offset from the longitudinal axis and have a diameter sufficient to encompass the outer perimeter of the PVC pipe. The resulting apertures are substantially similar to hyperbolic parabaloids which will allow long handled items such as a rake to penetrate the aperture from above but will somewhat resist removal of the long handled item in a transverse direction. A single such rack mounted in a horizontal fashion is suitable for long handled tools such as rakes and brooms. The invention includes the use of two such racks mounted vertically for items having protrusions at both ends such as kayak paddles, tools with enlarged handles and opposite the working end, etc.

DETAILED DESCRIPTION

Figure 1:
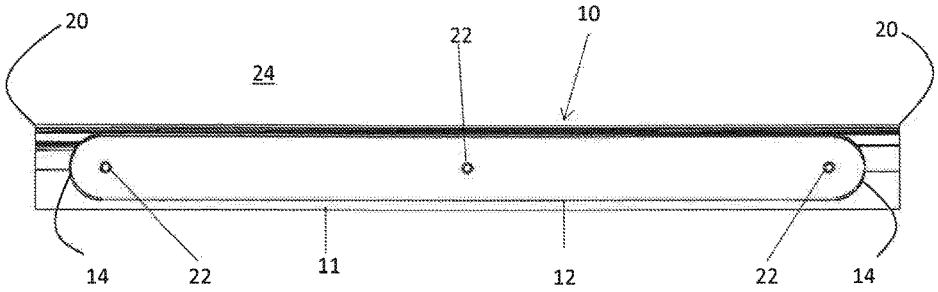
FIG. 1 is a side elevational view of a first embodiment of the invention in the configuration of a shoe rack.
Figure 2:
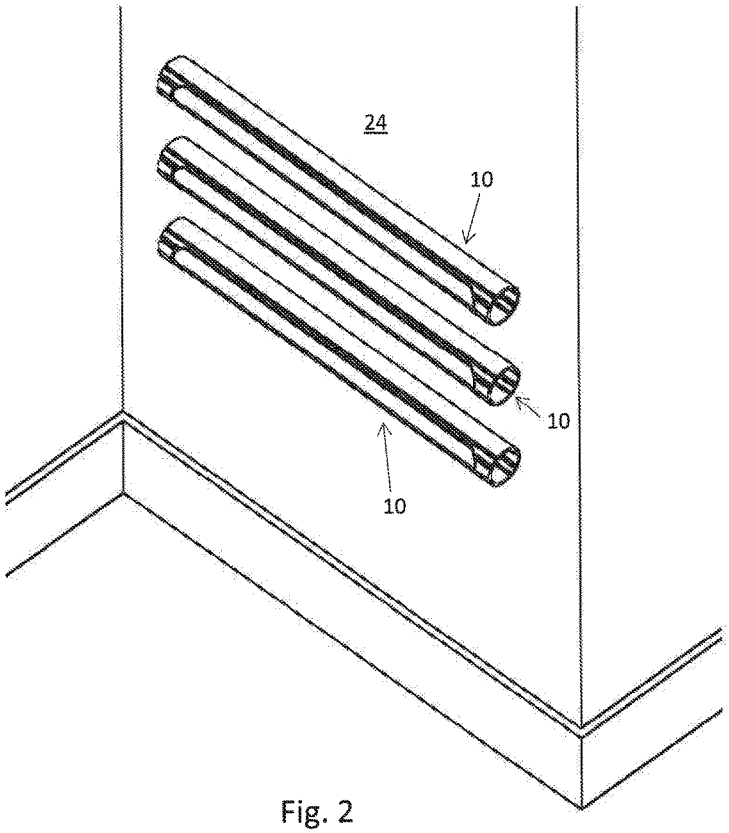
FIG. 2 is a perspective view of a plurality of shoe racks mounted on a wall in accordance with the invention shown in FIG. 1.
Figure 3:
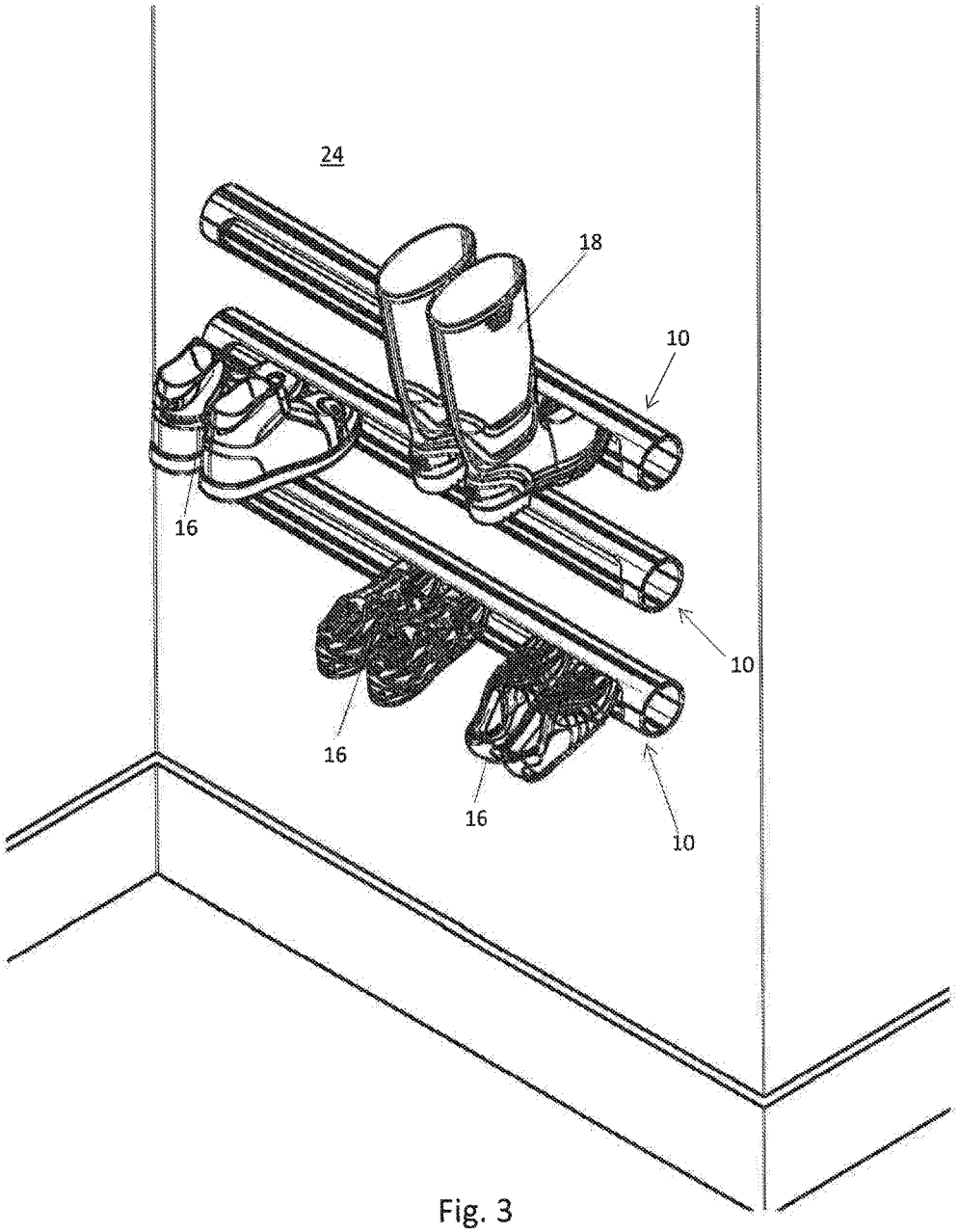
FIG. 3 is a perspective view of the shoe racks shown in FIG. 2 occupied by a plurality of shoes.

A rack for various items in accordance with the principles of the invention is generally indicated at reference numeral 10 in the various Figures of the attached drawings wherein numbered elements in the FIGS. correspond to like numbered elements herein. The rack 10 in its various embodiments is made from standard dimensional polyvinylchloride (hereinafter "PVC") piping having an elongated, substantially hollow cylindrical body 11 having a diameter selected in accordance with the ultimate use of the rack as a shoe rack, coat rack, rod/tool rack, etc. It is currently contemplated that the cylindrical body 11 either be standard 3 inch PVC tubing or standard 1.5 inch diameter PVC tubing. Such nominal dimensions do not accurately reflect the true dimensions of the standardize product. In reality standard 3 inch PVC tubing has an outer diameter of approximately 3.5 inch and an inner diameter of approximately 3.068 inches defining a wall thickness of 0.216 inch. Standard diameter 1.5 inch PVC tubing has an actual outer diameter of approximately 1.9 inches and an actual inner diameter of approximately 1.61 inches providing a wall thickness of 0.145 inch. Nevertheless, PVC tubing of this type is very inexpensive and typically in stock at home improvement stores throughout North America in a variety of lengths. Thus the invention advantageously utilized a common staple item for home constructions which is already strategically located in the vicinity of most peoples' homes. As will be discussed in further detail herein below, a home owner with typical tools such as a hole cutting drill bit, a saber saw or hack saw, a rotary forming tool such as a Dremel®, or even a rasp or a bastard file can form the necessary apertures in the pipe easily. Further yet, the home owner or do-it-yourselfer can form the rack in any desired length up to standard lengths of up to 20 feet available in most home improvement stores or cut the piping sections down to an appropriate size such as 36 inches long. The PVC material from which such pipes are manufactured, as well as the relatively thin wall thickness facilitates the forming of the various apertures with minimal labor. The material is sufficiently soft on the durometer scale to allow easy forming with hand tools such that jigs, vices and the like while helpful are not necessary.

Figure 13:
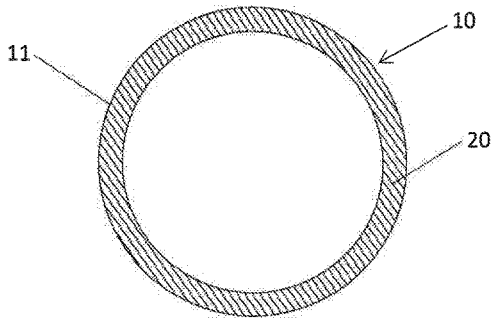
FIG. 13 is an end view of the rack shown in the various embodiments.

As best seen in FIG. 1, a first embodiment of the rack 10 in the form of a shoe rack has a single elongated aperture 12 terminating at radius ends 14 so as to form an elongated slot to accept shoes 16, boots 18 and the like in a cantilevered fashion. When a shoe is too small (kid's shoes) to be held "cantilevered" the rack acts as a trough to hold the shoes. The elongated aperture 12 preferably has a height of approximately 2.5 inches with standard 3 inch diameter PVC piping used for the cylindrical body 11. The aperture can be formed by first drilling two 2.5 inch diameter holes in the piping approximately 1.5 inches away from each end 20 if a thirty-six inch length of piping is used. The resulting circular holes are then connected by removing the material therebetween with a jigsaw, a hack saw or a circular saw to form a rebate in the elongated hollow cylindrical body 11 defined by the PVC pipe. The body also defines mounting drill through holes 22 at spaced intervals to support the rack from a support surface such as the wall 24 shown in the Figures. Various placements of the mounting holes in the rack allows adjustment of the mounting angle to determine the angle the shoe(s) will be held when cantilevered in the rack. We have found that there are certain angles that work better to hold different sizes of shoes. Adjusting the angle would also allow for boot and shoes to be held in an inverted position. It is contemplated that the rack 10 may comprise multiple cylindrical bodies 11, and which may be mounted on a free standing mobile structure, rather than the wall 24. Thus, as used herein the phrase "support surface" includes a free standing mobile structure such as a frame (not shown). The PVC pipe forming the cylindrical body 11 of the rack 10 may be left open ended as shown in FIG. 13 or may be closed with a decorative cap or wood plug. If used outside, leaving the ends 20 open is preferred as the shoe rack may be cleaned of debris simply by using a garden hose in the aperture 12 and allowing the water to run through the open ends 20.

Figure 4:
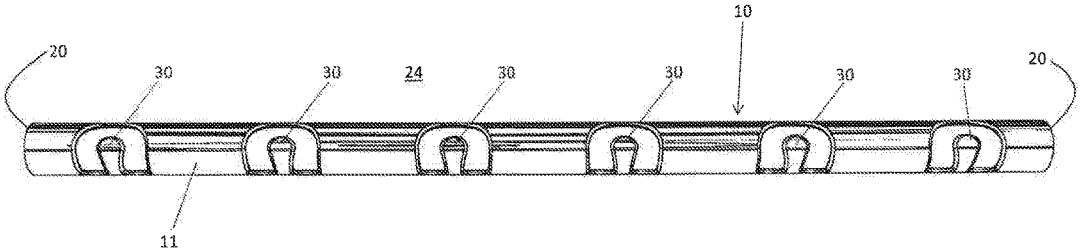
FIG. 4 is a side elevational view of a second embodiment of the invention in the form of a coat or clothing rack.
Figure 5:
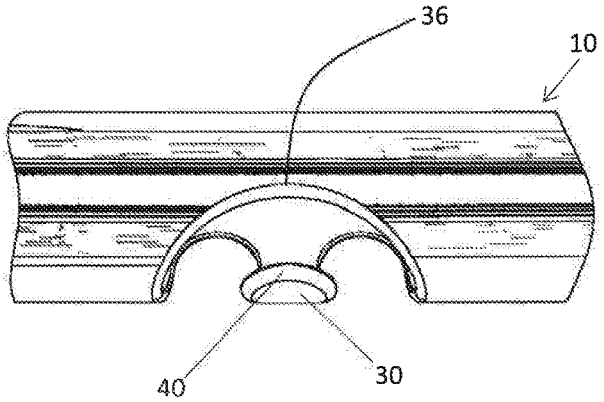
FIG. 5 is an enlarged top plan view of the invention shown in FIG. 4 illustrating the configuration of a hook portion of the invention.
Figure 6:
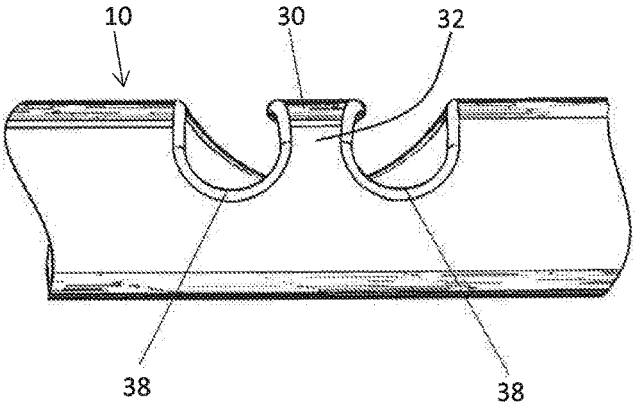
FIG. 6 is a bottom plan view of the rack invention shown in FIG. 4 further illustrating the configuration of the hook portion.
Figure 7:
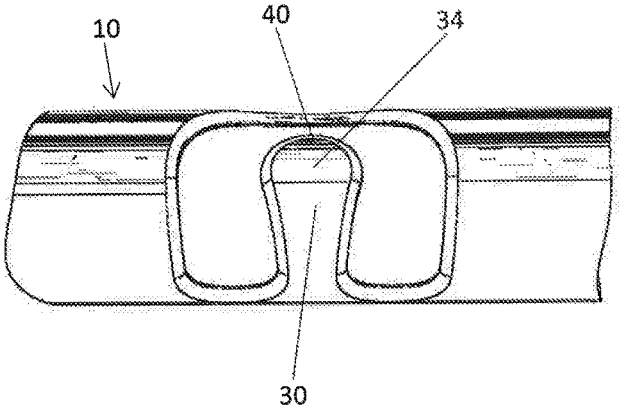
FIG. 7 is an enlarged, side elevational view of the rack shown in FIG. 4 illustrating the shape and dimensions of the hook portion within the aperture shown in FIGS. 4 through 6.
Figure 8:
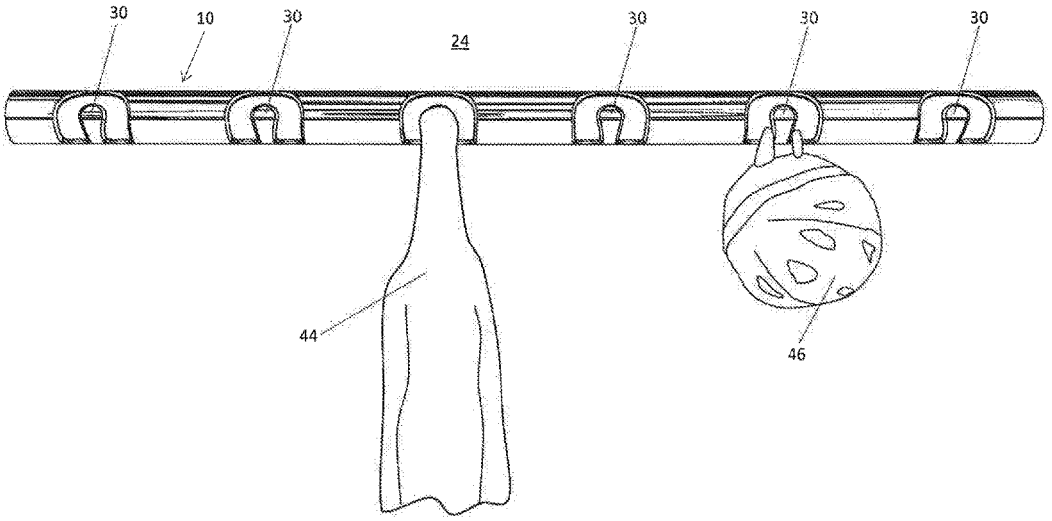
FIG. 8 is an environmental elevational view of the coat and clothing rack embodiment shown in FIGS. 4 through 7 in use with articles of clothing and other items.

A second embodiment of the rack 10 is shown in FIG. 4 having been modified for use as a coat rack. The rack includes a plurality of integral curved portions or tongues 30 formed in the PVC cylindrical body 11. The tongues may be placed at regular intervals such as twelve inches. As seen in FIGS. 5 through 7, the tongues have a substantial teardrop shape consisting of a laterally narrow stem portion 32 and a laterally enlarged head portion 34. Using standard 1.5 inch diameter PVC tubing, a preferred width for the stem portion is 0.65 inch and a preferred width for the head portion is 0.95 inch. The tongues 30 are formed by initially using a circular hole drill bit having a diameter of 2.5 inches with the center of the circular hole saw bit positioned just outside of the perimeter orf the cylindrical body but only penetrating halfway through the diameter of the tubing. This provides a semi-circular rebate 36 in the upper half of the cylindrical body 11 as seen in FIG. 5. As best seen in FIG. 6, two 0.85 inch diameter circular hole drill bits are used to provide a pair of semi-circular apertures from the underside of the tubing again penetrating only halfway through the tubing, The remaining material is now removed either with a hack saw or the like to form the tip portion 40 of the tongues 30 as best seen in FIGS. 5 and 7. Alternatively, the entire convoluted shape may be made freehand with a conventional rotary tool such as a powered rotary drywall tool. Once the tongues 30 have been formed the rack will assume the configuration shown in FIG. 8 and may be mounted on the wall to support coats 44, helmets 46 and the like. As will be apparent to those of ordinary skill in the art, the tongues 30 are contiguous with and thus do not protrude from the main body 11. As a result, this second embodiment provides a higher level of safety than conventional coat hooks because hooks/tongues are flush with the rest of the structure.

Figure 9:
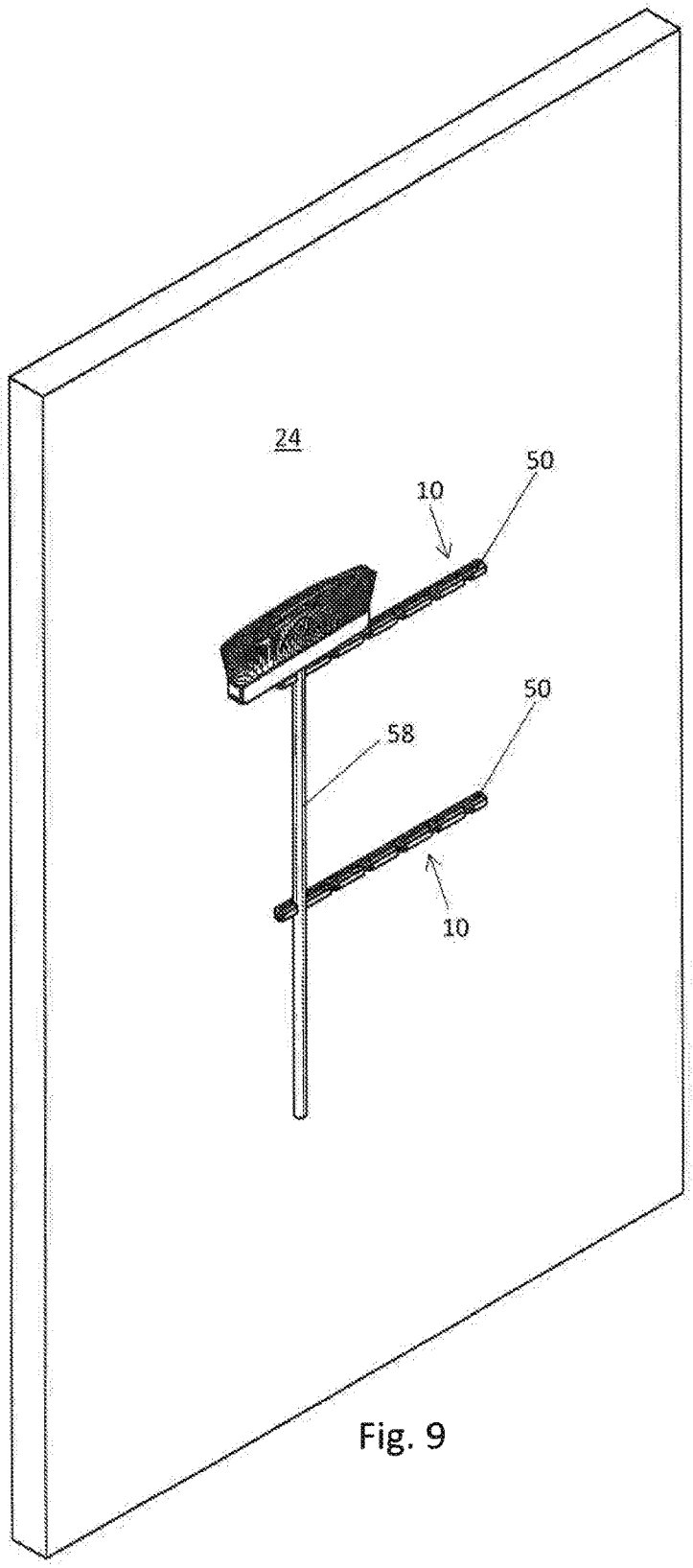
FIG. 9 is an environmental elevational view of a third embodiment of the invention in the form of a fishing rod/tool rack for holding those items against a support surface such as a wall.
Figure 10:
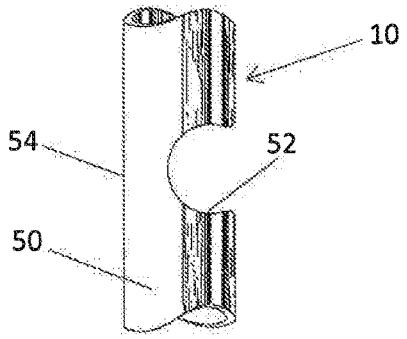
FIG. 10 is an enlarged, top plan view of the topology and geometric relationship of the spaced apart apertures in the tool rack with respect to the body of the rack.
Figure 11:
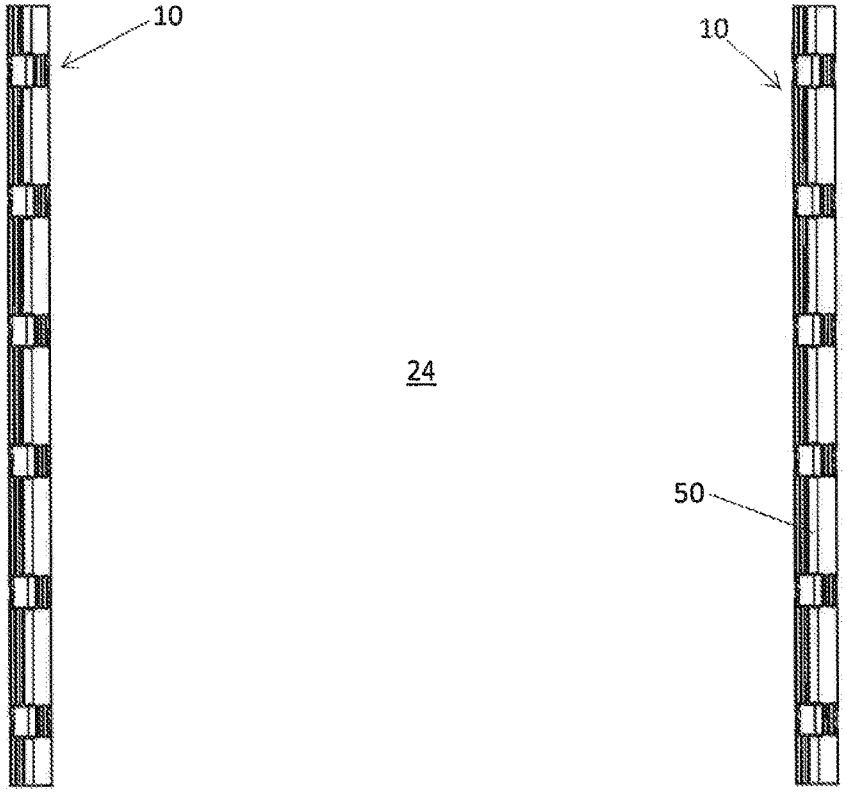
FIG. 11 is an environmental view of two fishing rod/tool racks mounted vertically on a wall for supporting items having bulbous protrusions at both ends.
Figure 12:
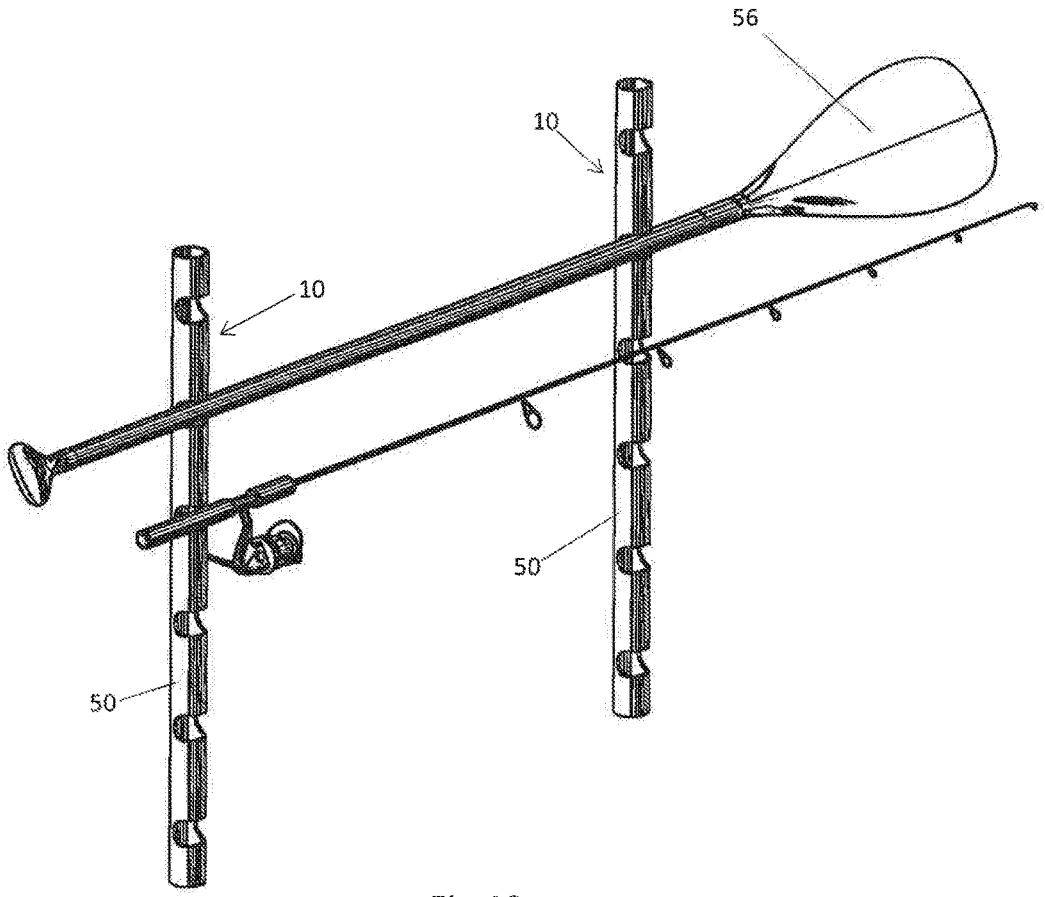
FIG. 12 is an environmental perspective view of the rack shown in FIG. 11 supporting a plurality of items such as kayak paddles and other tools.
Figure 14:
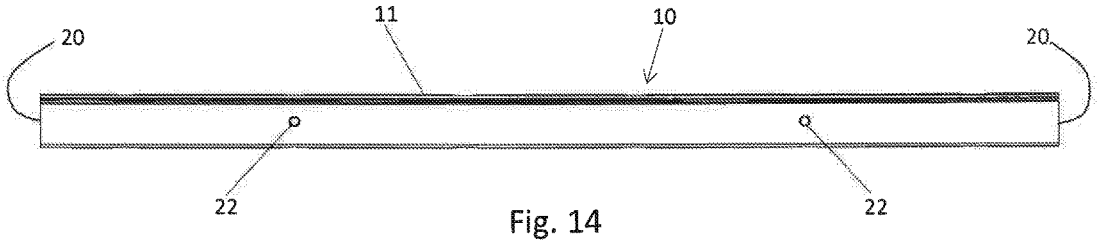
FIG. 14 is a rear elevational view of the rack shown in the various embodiments indicating that the rack may be of indefinite length.

A third embodiment of the rack 10 is shown in FIG. 9 in the form of a fishing rod/tool rack 50. The preferred diameter of tubing used for this embodiment is also the standard 1.5 inch PVC diameter tubing. Here the apertures 52 are provided by utilizing a 1.5 inch diameter circular hole drill bit having the drilling axis oriented transverse to the longitudinal axis of the PVC: tube and displaced 1.5 inches from an outer edge 54 of the tube. Stated another way, nominal 1.5 inch diameter PVC tube has an actual outer diameter of approximately 1.9 inches. Thus, the aperture 52 has its axis displaced approximately 0.4 inch from the longitudinal center of the tube. That diameter aperture will penetrate the sidewall of the tube and when driven transversely through the entire tube will provide an aperture that resembles a hyperbolic paraboloid which will readily admit a long handled tool wherein the handle has a diameter of less than 1.5 inches. However, the restricted minor axis of the hyperbolic parabaloid will discourage the tool from being withdrawn laterally from the rack 10 when the rack is in the horizontal position shown in FIG. 9 without carefully guiding the handle of the tool through the narrowed aperture thereat. Preferably, the apertures are positioned approximately six inches on center. FIG. 11 illustrates a modified version of the embodiment shown in FIG. 9. In this modified embodiment, two racks 10 are positioned vertically on a support surface such as the wall 24 for support of tools and items having enlarged ends such as the kayak paddles 56 shown in FIG. 12 or for example a brush 58 having an enlarged handle which otherwise would not fit through the 1.5 inch diameter aperture shown in FIG. 10. Any suitable length for the PVC pipe can be selected for the embodiment shown in FIGS. 11 and 12, however a standard length of 36 inches is preferred. FIG. 14 shows that the rack 10 may be of indefinite length or any length selected by the end user. In the event a tool, rod or paddle is cantilevered while being held in the rack because one end is heavier than the other on one side will be cradled in the lower trough and the lighter end held in upper trough, cantilevered into place. The tool will not teeter and fall out of the rack. This embodiment also provides a higher level of safety then conventional tool racking pegs because racking flush with the rest of the structure.

The invention and its various embodiments described above advantageously utilizes a product, PVC piping, which is already in stock at home improvement centers throughout North America. The invention advantageously permits a homeowner to utilize conventional tools such as hole drill bits, saber saws, jigsaws, rotary tools and files to create the longitudinal or transverse apertures and tongues which permit the rack to perform various functions such as a shoe rack, a coat rack, a tool rack, a fishing rod rack, and the like. In a horizontal configuration, the rack may have the orientation of the longitudinal or transverse apertures varied with respect to the support surface such as the wall to provide extra security for such items against the force of gravity acting thereupon. A further advantage of the invention resides in the ability of home owners or the like to obtain templates and dimensional instructions for manufacture of the various specific forms of the rack through the mail, the internet, and the like without product having to be shipped from a manufacturer directly to the home owner. As a result, all of the costs associated with shipping the product, conforming the product and stocking the product need not be borne by a manufacturer as the cost of stocking in particular has already been borne by the home improvement centers. In sum, the invention advantageously utilizes the existing distribution system for a common construction item to supplant a whole range of use specific racks for shoes, tools, clothing and the like. These efficiencies and economies of scale can be equally shared by both the end user and the home improvement centers who already stock these materials. Finally, the racking structures allow flexibility in anchor placement to help match the variability in mounting structure. You can put a screw in where ever it is wanted, and the rack can be also be made and manufactured out of any material e.g. wood, metal, different types of plastics and composites.

Those of ordinary skill in the art will conceive of other alternate embodiments of the invention upon reviewing this disclosure. Thus, the invention is not to be limited, to the above description, but is to be determined in scope by the claims which follow.

The invention claimed is:

1. An elongated rack for attachment to a support surface for supporting items of clothing, tools or shoes, comprising: an elongated, substantially hollow cylindrical body defining a longitudinal axis and at least one transverse aperture for receipt of a plurality of items; wherein the aperture includes an integral curved portion in the form of a hook for supporting items of clothing therefrom, the hook having a laterally enlarged head portion and a laterally narrow stem portion; and, means for mounting the rack on the support surface; wherein the head has a width of approximately one inch, the stem portion has a width of approximately 0.65 inch, and the cylindrical body has an outer diameter of approximately 1.9 inches.

* * * * *